US007880105B2

(12) United States Patent
Hashimoto et al.

(10) Patent No.: US 7,880,105 B2
(45) Date of Patent: Feb. 1, 2011

(54) CIRCUIT BREAKER

(75) Inventors: Hiroaki Hashimoto, Hitachinaka (JP); Hideo Kawamoto, Toyokawa (JP); Kenichi Okubo, Hitachi (JP)

(73) Assignee: Japan AE Power Systems Corporation, Tokyo (JP)

( * ) Notice: Subject to any disclaimer, the term of this patent is extended or adjusted under 35 U.S.C. 154(b) by 232 days.

(21) Appl. No.: 12/302,822

(22) PCT Filed: May 15, 2007

(86) PCT No.: PCT/JP2007/060317

§ 371 (c)(1),
(2), (4) Date: Nov. 28, 2008

(87) PCT Pub. No.: WO2007/138900

PCT Pub. Date: Dec. 6, 2007

(65) Prior Publication Data

US 2009/0201109 A1 Aug. 13, 2009

(30) Foreign Application Priority Data

Jun. 1, 2006 (JP) ..... 2006-153597

(51) Int. Cl.
*H01H 33/42* (2006.01)
*H01H 33/38* (2006.01)
*H01H 33/40* (2006.01)

(52) U.S. Cl. ..... 200/400; 200/17 R; 218/154

(58) Field of Classification Search ..... 200/17 R, 200/400, 401; 218/84, 120, 140, 153, 154
See application file for complete search history.

(56) References Cited

U.S. PATENT DOCUMENTS 6,232,569 B1 * 5/2001 Nakajima et al. ..... 200/400
6,348,847 B1 * 2/2002 Nakajima et al. ..... 335/195

(Continued)

FOREIGN PATENT DOCUMENTS

JP 54-87875 7/1979

(Continued)

OTHER PUBLICATIONS

H. Kohyama et al., Development of 362kV 50kA Spring Operating $SF_6$ Gas Circuit Breaker, Japanese Heisei 9year Electro-technical Committees Energy Branch Meeting Lecture Papers, 1997.

*Primary Examiner*—Ramon M Barrera
(74) *Attorney, Agent, or Firm*—Mattingly & Malur, P.C.

(57) ABSTRACT

A circuit breaker of different interruption speeds, and a spring operation mechanism is standardized for designing and manufacturing the circuit breaker. The circuit breaker has a power transmission mechanism for driving a movable contact 63 and a fixed contact 64 and an interruption spring 26 that imparts a driving force to separate the contacts through the power transmission mechanism. A latch mechanism restricts movement of the power transmission mechanism, and a pull-out operation section releases the restriction of the power transmission mechanism by the latch mechanism. The pull-out operation section is arranged to oppose a first arm of a lever to rotate the first arm. The lever is arranged so that a tip of a second arm is able to engage with and rest on the latch mechanism, and release the restriction of the power transmission mechanism by the latch mechanism.

4 Claims, 12 Drawing Sheets

U.S. PATENT DOCUMENTS

| | | | | |
|---|---|---|---|---|
| 6,563,067 | B2 * | 5/2003 | Ohtsuka et al. | 200/400 |
| 7,009,130 | B2 * | 3/2006 | Hashimoto et al. | 200/400 |

FOREIGN PATENT DOCUMENTS

| | | |
|---|---|---|
| JP | 07-320609 | 12/1995 |
| JP | 2529264 | 8/1996 |
| JP | 2001-283691 | 10/2001 |
| JP | 2003-068172 | 3/2003 |
| JP | 2004-259570 | 9/2004 |
| JP | 2005-209554 | 8/2005 |
| JP | 2006-024481 | 1/2006 |

* cited by examiner

CIRCUIT BREAKER

TECHNICAL FIELD

The present invention relates to a circuit breaker employing a spring operation apparatus, and to a circuit breaker suitable as a power gas circuit breaker of high voltage specification for a transformer station, a switching station, etc.

TECHNICAL BACKGROUND

A power gas circuit breaker provided in a transformer station or a switching station employs a spring operation apparatus employing a spring as driving force for interrupting or closing. A circuit breaker employing this kind of spring operation apparatus is disclosed in JP 2001-283691 A (document 1), for instance. This publication discloses closing of a make and break contact which is an interruption part by releasing an energized state on the base of a cam mounted on a rotation shaft, a lever and an operation command, and an operation apparatus of spring operation type using an interruption spring, etc. This spring operation apparatus does an interruption operation by holding a driving force of the interruption spring by engagement of a plurality of parts constructing a pull-out mechanism, and by releasing the engagement of the plurality of parts by driving a solenoid according to an interruption command.

Further, a spring operation apparatus for opening and closing a contact portion of a power circuit breaker is also disclosed in JP 2005-209554 A (document 2). This spring operation apparatus is made so as to add a case containing a pull-out mechanism or a closing mechanism to a case of a body of the operation apparatus.

Further, a spring operation apparatus by a torsion bar is disclosed in Japanese patent publication No. 2529264 (document 3). This spring operation apparatus uses the torsion bar for driving force of interruption and closing, and it is made compact and its high speed operation is made possible, by using the bar in a state that 2 torsion bars are folded.

Further, Japanese Heisei 9 year (1997) Electro-technical Committees Energy Branch Meeting Lecture Papers "Development of 362 kV 50 kA spring operation gas circuit breaker" by Haruhiko Kayama and others (document 4) also discloses an example of a torsion-bar type spring operation gas circuit breaker. The spring operation apparatus employed therein uses a torsion bar as a driving spring, whereby less energy is needed for driving the spring itself, the efficiency is good, it is possible to it large in output, and the make and break contact which is an interruption portion can be interrupted in an interruption time of 2 cycles.

Incidentally, the spring operation apparatus for circuit breaker as mentioned in the document 1 is for 3-cycle interruption, the document 1 does not take into consideration about designing and manufacturing circuit breakers satisfying a plurality of different interruption speeds such as high speed interruption, for example, interrupting the make and break contact of an interruption portion in 2 cycle, and low speed interruption, for example, interrupting in 5 cycles. The spring operation apparatus for circuit breaker disclosed in above-mentioned document 2 has a problem that it is difficult to meet the requirement of making the circuit breaker high in interruption speed.

Similarly, the torsion-bar type spring operation apparatus disclosed in the document 3 can interrupt a make and break contact which is an interruption portion in 2 cycles, however, it is not taken into consideration about using the spring operation apparatus for low speed interruption such as 3 cycles, so that it has a problem that it can not be used for low speed interruption.

In the other words, the conventional techniques of spring operation apparatuses used for circuit breakers never take into consideration about making parts of the spring operation apparatus common or standardize so as to able to make a make and break contact which is a interruption portion interrupt in different interruption cycles, so that there remains a problem that designing and manufacturing of the circuit breakers becomes complicated.

An object of the present invention is to reduce working time of designing and manufacturing circuit breakers of different interruption speeds, by making it possible to satisfy, even if different interruption speeds are required for circuit breakers of the same construction, the requirement, and by making parts of the spring operation apparatuses common or standardize.

DISCLOSURE OF THE PRESENT INVENTION

In order to attain the above-mentioned object of the present invention, the present invention provide a circuit breaker which comprises a power transmission mechanism for driving a movable contact and a fixed contact constructing a make and break contact in a direction that the contacts separate from each other and contact thereon, an interruption spring imparting driving force in a direction that the driving force separates the movable contact from the fixed contact through the power transmission mechanism, a latch mechanism for restricting movement of the power transmission mechanism at a place that an energized condition of the interruption spring is held, and a pull-out operation section for releasing the restriction of the power transmission mechanism by the latch mechanism, and the circuit breaker is characterized in that the pull-out operation section is provided with a lever having first and second arms and rotatably supported on a shaft, and operation means for rotating the first arm, the operation means being arranged so as to oppose to the first arm of the lever, the lever is arranged so that a tip of the second arm is able to engage with and rest on the latch mechanism, and made so that the restriction of the power transmission mechanism by the latch mechanism is released by rotation of the lever, a gap between the first arm and the operation means is set smaller for low speed interruption than for high speed interruption, and a dimension of length from a center of rotation of the first arm to a perpendicular line that an operation axis of the operation means is extended is set smaller for high speed interruption than for low speed interruption.

The number of interruption cycles (interruption speed) of the circuit breaker depends mainly on movement speed of the pull-out operation section keeping the energized condition of the interruption spring and releasing the latch mechanism which restricts the closing state. Here, in the present invention, only a portion of the pull-out operation section is designed and manufactured as separate part or parts for each required interruption speed specification, whereby different interruption speeds are satisfied by the circuit breakers of the same construction. Thereby, it is possible to make the spring operation apparatuses and other construction parts constructing the circuit breakers common and standardize, and it is possible to reduce the working time of designing and manufacturing the circuit breakers.

Further, it is characterized that a lever ratio of the dimension of length from the center of rotation of the first arm to the perpendicular line that the operation axis of the actuator is extended to a dimension of length from the center of rotation of the lever to a tip end of the second arm is set larger for high speed interruption than for low speed interruption, preferably, that the lever ratio for high speed interruption is set 1.5 times or more of that for low speed interruption. Thereby, it is possible to make a construction satisfying the interruption speed specification without making the construction of the Pull-out operation section greatly different.

The operation means comprises a solenoid driving a plunger to go forward and backward, and the number of windings of a coil of the solenoid is less for high speed interruption than for slow speed interruption, or the solenoid is constructed of an iron core made of material different in both magnetic property and specific resistance between for high speed interruption and for low speed interruption, whereby different interruption speed specifications of the make and break contacts are satisfied by the circuit breakers of the same construction.

According to the present invention, even by the circuit breakers of the same construction, it is possible to easily provide the circuit breakers having different interruption performances such as 2 cycle interruption, 3 cycle interruption or 5 cycle interruption, only by exchanging the pull-out operation sections. Further, by exchanging the pull-out operation mechanism, it is possible to construct one circuit breaker for 2 cycle interruption, 3 cycle interruption, etc. of interruption time of the circuit breaker by exchanging the interruption time.

AN EFFECT OF THE PRESENT INVENTION

According to the present invention, even if circuit breakers of different interruption speeds are required, the requirement is satisfied by the circuit breaker of the same construction, and it is possible to make the spring operation mechanisms common or standardize, so that it is possible to reduce working time for designing and manufacturing the circuit breakers of different interruption speed.

BEST MODE FOR PRACTICE OF THE PRESENT INVENTION

An embodiment of the power gas circuit breaker that the present invention is applied is explained hereunder, referring to FIGS. 1 to 13, with the same symbols being given to the same function parts.

Figure 1:
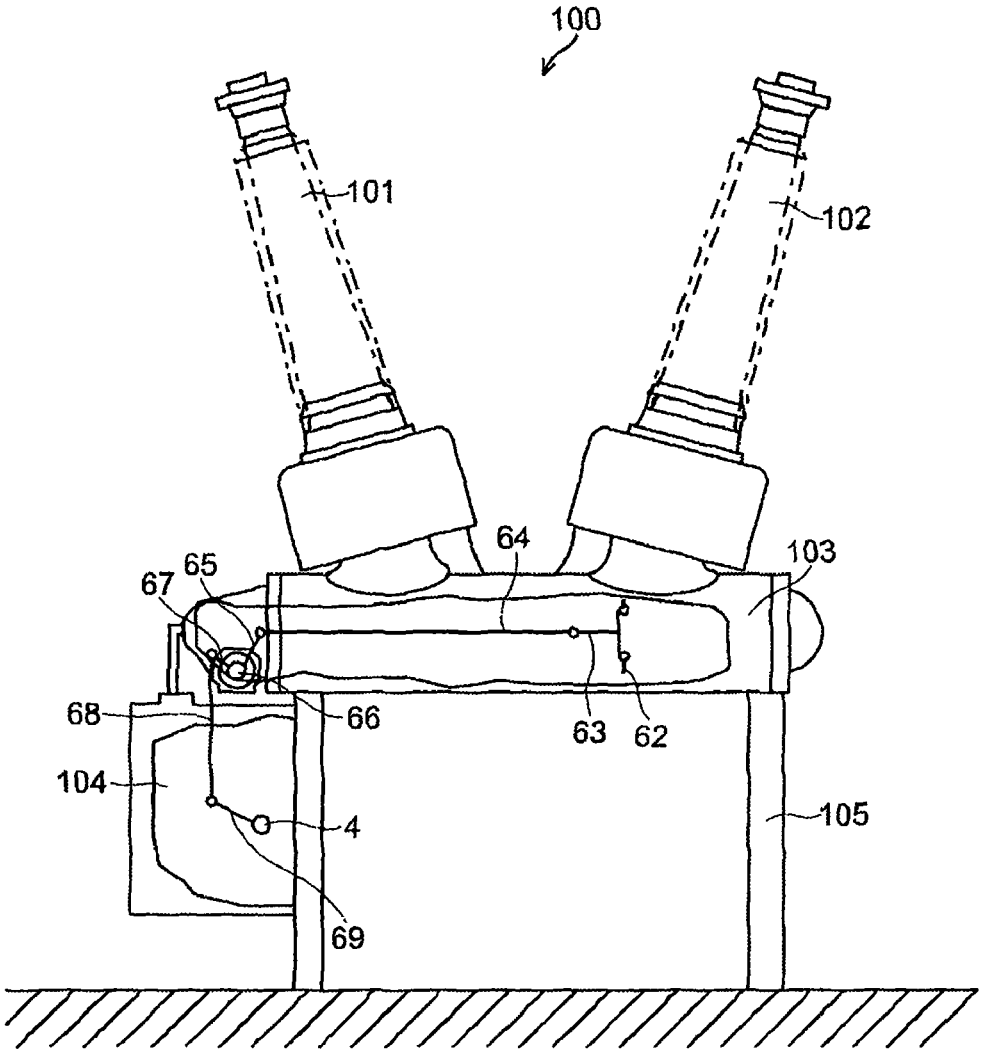
FIG. 1 is a front view of an embodiment of a power gas circuit breaker that the present invention is applied.

A gas circuit breaker 100 shown in FIG. 1 has a cylindrical grounded container 103 set on a frame 105, and an insulating gas such as $SF_6$ (sulfur hexafluoride gas) is enclosed in the cylindrical grounded container 103 at a normal pressure. Further, bushings 101, 102 are provided on the grounded container so as to project obliquely upward. Within the bushings 101, 102, conductors constructing electric paths by connecting electric wires inside a transformer station or switching station are contained. An operation box 104 containing a spring operation mechanism of the gas circuit breaker 100 is mounted on the side of the frame 105.

This FIG. 1 shows a state that a make and break contact which is an interruption portion is closed, a movable contact 63 constructing the make and break contact is contacted with a fixed contact 62. During interruption operation, the movable contact 63 removes from the fixed contact 62. An end portion of the movable contact 63 opposite to a contact portion with the fixed contact 62 is connected to an insulating member 64. Further, a rotating shaft 66 is supported rotatably on the grounded container 103, and ends of a link 65 and a link 67 are fixed to the rotating shaft 66. The other end of the link 65 is connected to one end of the insulating member 64. Similarly, the other end of the link 67 is connected to a link 68.

A main shaft 4 of the spring operation mechanism is provided inside the operation box 104. In an example shown in FIG. 1, an end of the link 69 is connected to the main shaft 4, and the other end of the link 69 is connected to the link 68. The main shaft 4, the links 69, 68, 67 and the rotating shaft 66 forms a quatre link mechanism. The spring operation mechanism is connected to the make and break contact which is the interruption portion in the grounded container 103 by the quadric link mechanism.

An operation of the gas circuit breaker 100 constructed in this manner will be explained hereunder. Power during passage of current is supplied to the upstream side bushing 102 from a system (not shown). The power is led to the make and break contact which is the interruption portion in the grounded container 103 from the bushing 102, and is supplied again to the system through the downstream side bushing 101.

When some accident occurs in the system by thunderbolt or the like, the spring operation mechanism in the operation box 104 is driven, whereby the main shaft 4 and the link 69 are rotated counterclockwise and the link 68 is moved downward. As the link 68 moves, the link 67, the rotating shaft 66 and the link 65 rotate counterclockwise, whereby the insulating member 64 is moved leftward. Thereby, since the movable contact 63 is separated from the fixed contact 62 and opened, the power supply to a downstream side is interrupted.

Further, in the present embodiment, the grounded container 103 is placed to extend horizontally, however, it is also possible to place the grounded container 103 so as to extend perpendicularly. Still further, the explanation is made by using a single gas circuit breaker having the bushings 101, 102 directly mounted on the grounded container 103, however, such a construction that the bushings 101, 102 are assembled into the grounded container 103 having the make and break contact is also sufficient. Still further, the explanation is made taking the gas circuit breaker using $SF_6$ gas as an example, however, other kinds of switching apparatus such as a vacuum circuit breaker are also sufficient.

Next, the spring operation mechanism 400 contained in the operation box 104 will be explained, referring to FIGS. 2 to 5.

Figure 2:
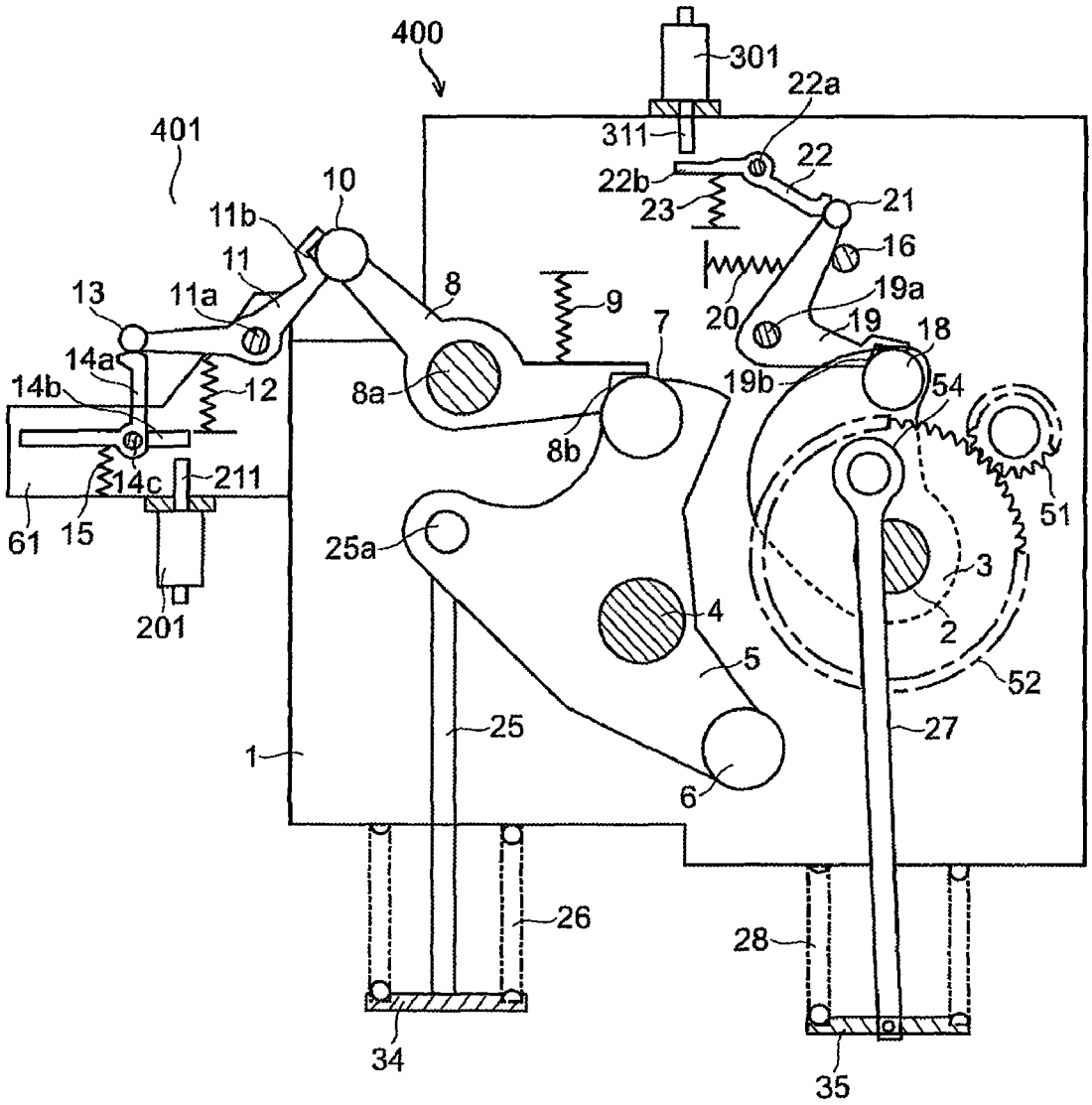
FIG. 2 is a diagrammatic illustration showing an embodiment of an operation apparatus of the power gas circuit breaker that the present invention is applied.
Figure 3:
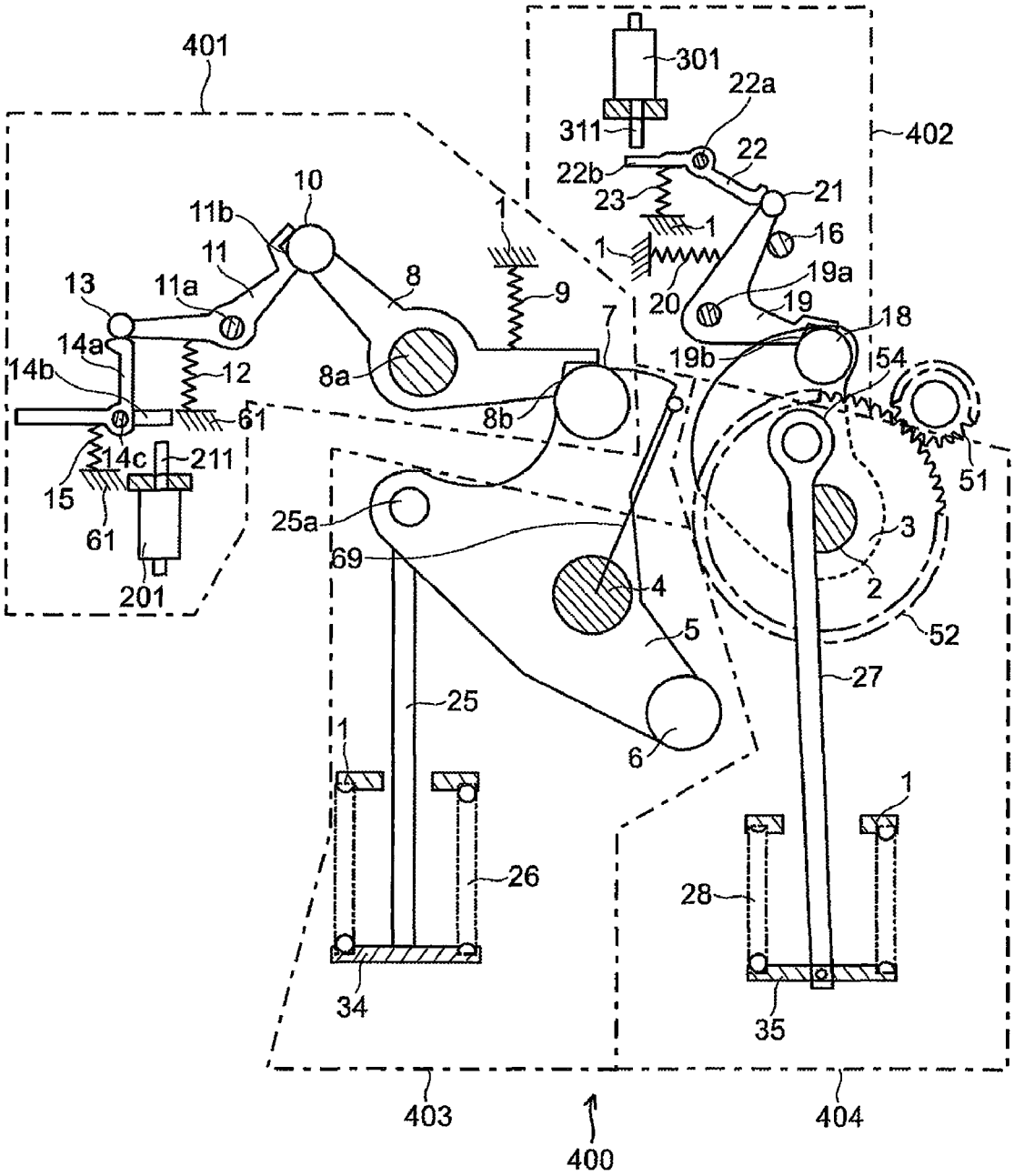
FIG. 3 is a diagrammatic illustration for explaining a closing state of a make and break contact at the operation apparatus of the power gas circuit breaker shown in FIG. 2.
Figure 4:
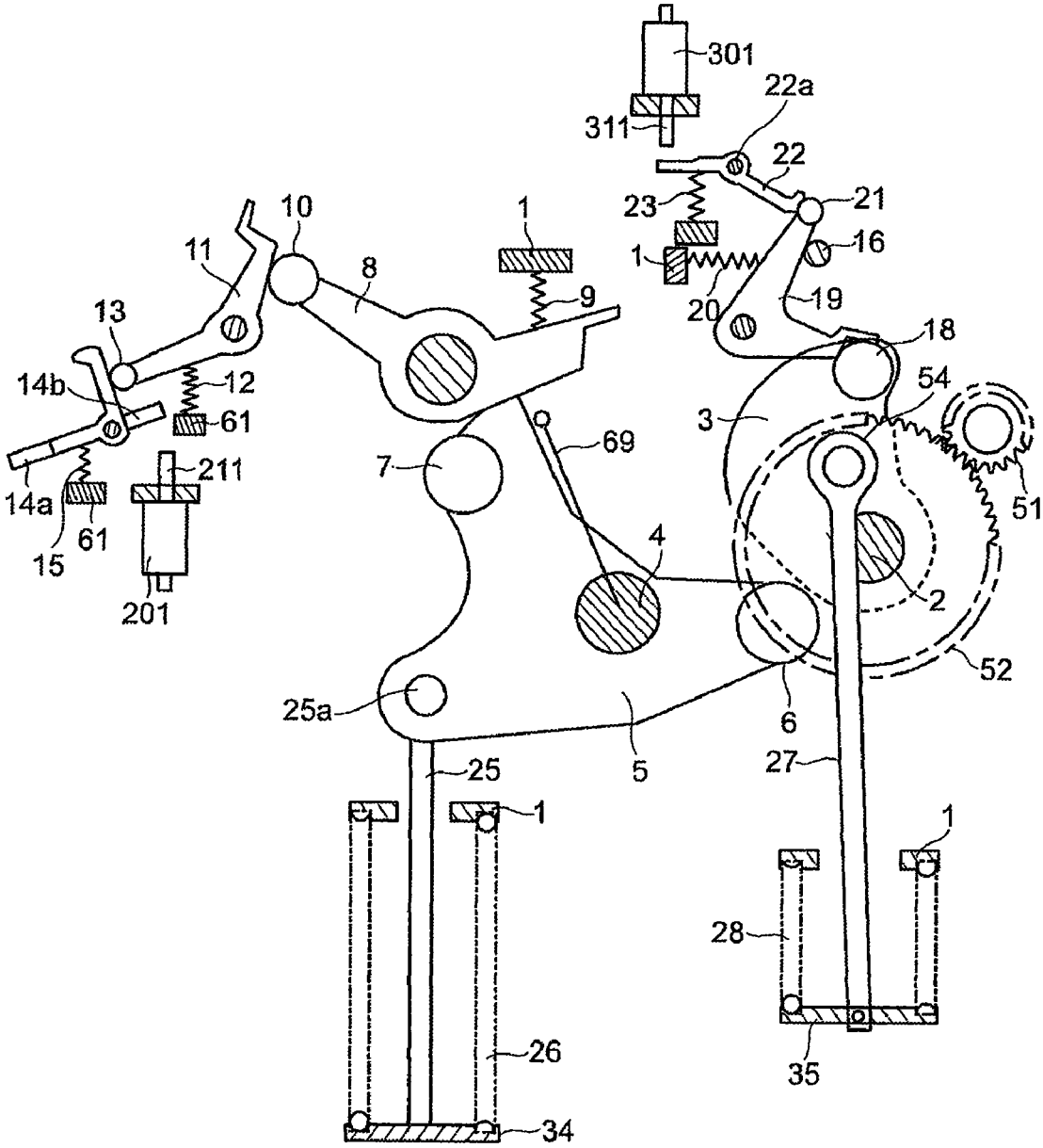
FIG. 4 is a diagrammatic illustration for explaining a termination state of interruption operation of the make and break contact at the operation apparatus of the power gas circuit breaker shown in FIG. 2.
Figure 5:
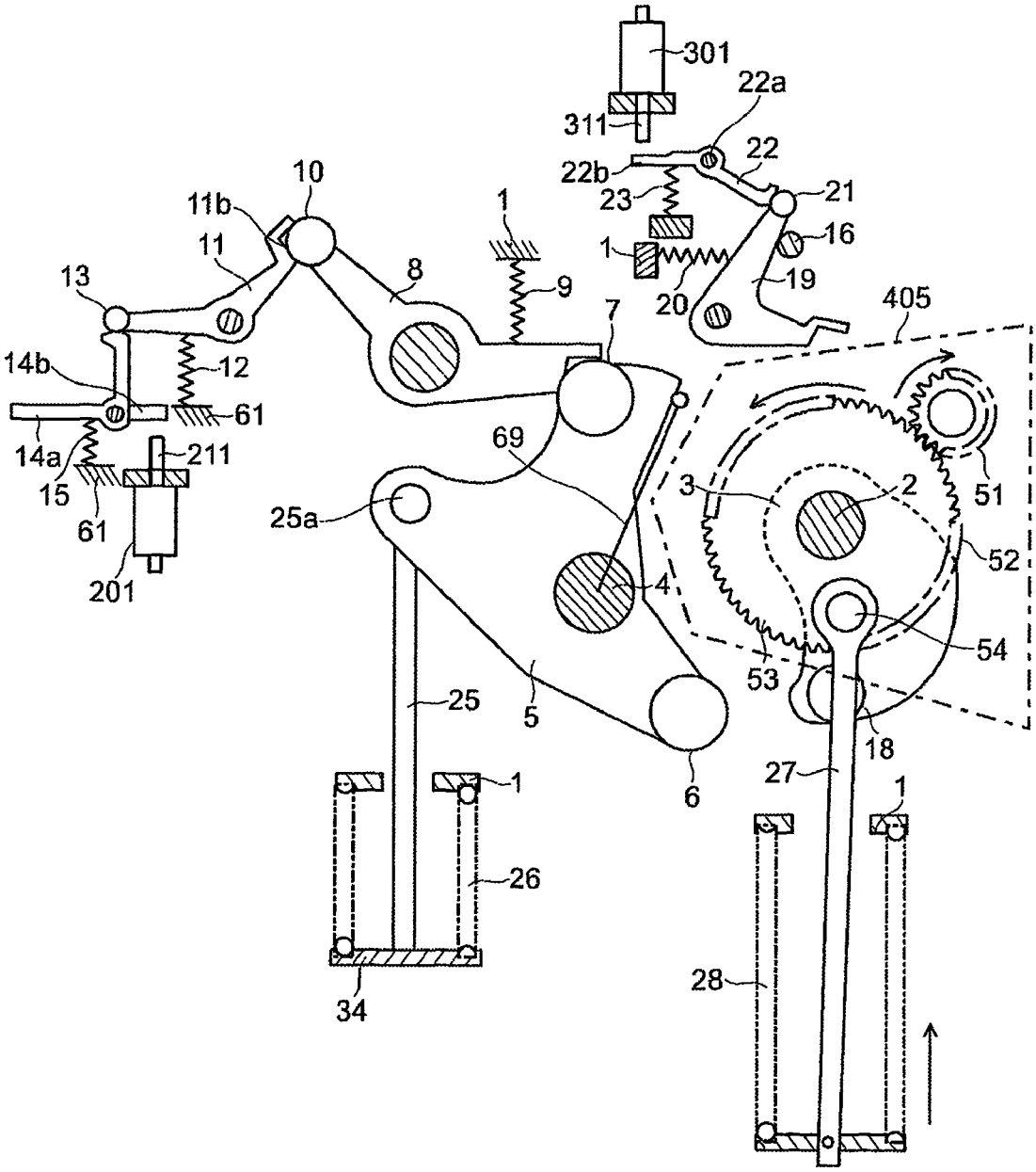
FIG. 5 is a diagrammatic illustration for explaining a termination state of interruption operation of the make and break contact at the operation apparatus of the power gas circuit breaker shown in FIG. 2.

FIGS. 2 and 3 show a closing state of the make and break contact that both of a closing spring 28 and an interruption spring 26 of the spring operation mechanism 400 are compressed., and as it changes from FIG. 3 to FIG. 5, the opening and closing operation of the make and break contact progress in turn. As shown in FIG. 2, the spring operation mechanism 400 is constructed by a case 1 and small case 61, and the small case 61 is fastened to the case 1 by bolt or the like so as to be added to the case 1.

The spring operation mechanism 400, as shown by enclosing with a one-dotted line in FIG. 3, is composed of an interruption operation section 403 having the main shaft 4 and an interruption spring 26, etc, a closing operation section 404 having a cam shaft 2 an a closing spring 28, etc, a closing control mechanism 402 keeping or releasing a driving force of the closing spring 28, a pull-out mechanism 401 keeping and releasing a driving force of the interruption spring 26, and a closing spring energizing apparatus 405 shown in FIG. 5 and including a part of the closing operation section 404.

The state that an interruption operation of the make and break contact is finished is shown in FIG. 4, and the state that a closing operation of the make and break contact is finished is shown in FIG. 5. In the state of FIG. 5, the closing spring 28 is in an opening state, after that, the closing spring 28 is compressed and an operation to return it into a condition shown in FIG. 2 is done. the above operation will be explained later in detail.

A construction of the interruption operation section 403 is explained, referring to FIG. 3.

An intermediate portion of a main lever 5 which is approximately Y-letter shaped is mounted on the main shaft 4, and rollers 6, 7 are mounted on two end portions of the main lever 5. Further, on the remaining end of the main lever 5, an end of an interruption spring link 25 is mounted rotatably through a pin 25*a*. On the other end of the interruption spring link 25, a spring bearing 34 is mounted, and holds an interruption spring arranged around the outer periphery of the interruption spring link 25. The interruption spring 26 is held by the case 1 at an opposite side of the end supported by the spring bearing 34.

By the insulating member 64, link 65 and quatre link mechanism, shown in FIG. 1 as mentioned above, the main lever, the interruption spring link 25 and the spring bearing 34, a power transmission mechanism driving the movable contact 63 and the fixed contact 62 constructing the make and break contact in a contact and separate direction is constructed. Further, the interruption spring 26 is constructed so as to impart driving force in a direction to separate the movable contact 63 from the fixed contact 62 through the power transmission mechanism.

Next, a construction of the closing operation section 404 and the closing spring energizing apparatus 405 is explained, referring to FIG. 3 and FIG. 5.

A cam 3 is mounted on one end of the rotating shaft 2 rotatably supported inside the case 1, and a large gear wheel 52 is mounted on the other end of the rotating shaft 2. An end of a closing spring link 27 is rotatably mounted on intermediate portion of the large gear wheel 52. A spring seat 35 is mounted on the other end portion of the closing spring link 27, and holds one end side of the closing spring 28. The closing spring 28 is arranged on the outer peripheral side of the closing spring link 27, and the opposite side of the spring seat 35 is held by the case 1. A driving force is transmitted to a small gear wheel 51 from an electric motor (not shown), and when the closing spring 28 is energized, the small gear wheel 51 becomes a driving side and the large gear wheel 52 becomes a follower side. On the contrary, in a closing operation, the large gear wheel 52 becomes a driving side and the small gear wheel becomes a follower side.

A construction of the closing control mechanism 402 is explained, referring to FIG. 3. A closing latch 19 is mounted on a roller 18 mounted on the cam 3 so as to be able to engage with the roller 18. The closing latch 19 is formed in an approximate V-letter shape, the curved portion thereof is mounted rotatably on a shaft 19*a*. An engaging portion 19*b* is formed at one end of the closing latch 19 of the approximate V-letter shape, and the engaging portion 19*b* engages with a roller 18 provided on the cam 3 of the closing operation section 404. A roller 21 is mounted on the other end of the closing latch 19 of the approximate V-letter shape. A return spring 20 of which one end is fixed to the case 1 is mounted on an intermediate portion between the other end of the closing latch 19 and the shaft 19*a*.

A closing trigger 22 is arranged so that one end of the trigger is able to abut the roller 21. The closing trigger 22 is formed in a bent shape, and the bent portion thereof is mounted rotatably on a rotating shaft 22*a*. The rotating shaft 22*a* is rotatably supported on the case 1. A closing trigger 22*b* is formed on an opposite end to the side that the closing trigger 22 abuts the roller 21, and a plunger 311 of a closing solenoid 301 which becomes an operation means is arranged so as to bale to abut this closing trigger 22*b*.

Adjacently to the above-described interruption operation section 403, the pull-out mechanism 401 is arranged inside a small case 61. A structure of the pull-out mechanism 401 is explained, referring to FIG. 3. An interruption latch 8 is rotatably mounted on the shaft 8*a* fixed to the case 1 at a middle portion of the latch and has a shape bent at the shaft 8*a*. An engaging portion 8*b* formed at one end of the interruption latch 8 is engaged with a roller 7 provided on one end of the a main lever 5, and a roller 10 is attached to the other end of the interruption latch 8. Further, one end of a return spring 9 for restoring the interruption latch 8 to the original position is mounted on an intermediate portion between the shaft 8*a* and the engaging portion of the interruption latch 8. The other end of the return spring 9 is fixed to the case 1.

A second trigger lever 11 is arranged so as to be able to engage with the roller 10 provided at one end of the interruption latch 8. An intermediate portion of the second trigger lever 11 is rotatably mounted on a shaft 11*a* supported by the small case 61. Further, the second trigger lever 11 is formed in a shape bent at a portion of the shaft 11*a*, and the second trigger lever 11 has one end of a return spring 12 mounted on an intermediate portion thereof between the shaft 11*a* and a roller 13. The other end of the return spring 12 is fixed to the small case 61, and the return spring 12 restores the second trigger lever 11 to an original place by spring force. The second trigger lever 11 has a roller 13 mounted on an end portion thereof on the opposite side to an engage portion engaging with the roller 10. An interruption trigger 14*a* which is shaped in approximate L-letter is arranged so as to be able to engage with the roller 13, and formed so that a tip portion of the interruption trigger 14*a* abuts the roller 13. The tip portion of the interruption trigger 14*a* is formed in curved face, taking its contact with the roller 13 into consideration.

An angled portion of the approximate L-letter shape of the interruption trigger 14*a* is fixed to a shaft 14*c*. The shaft 14*c* is supported rotatably by the small case 61, and provided with a first trigger lever 14*b* attached thereto. A plunger 211 of a pull-out solenoid 201 which is an operating means is arranged for the first trigger lever 14*b* so as to be able to abut. A return spring 15, one end of which is fixed to the small case 61, is provided at an intermediate portion of the interruption trigger 14*a*. The interruption trigger 14 is restored to an original place by the return spring 15. The above-mentioned return springs 9, 12 and 15 each are in compressed condition under the closing hold condition holding a closing state as shown in FIG. 2. In this embodiment, the return springs 9, 12 and 15 each are a coil spring, however, such springs as twisted springs, dish springs, etc. can be used for the return springs.

In this manner, the latch mechanism restricting, by the interruption latch 8, movement of the power transmission mechanism at a position that an energizing condition of the interruption spring 26 is held is constructed. The pull-out operation section releasing, by the second trigger lever 11, the interruption trigger 14*a*, the first trigger lever 14*b*, the pull-out solenoid 201, etc., the restriction of the power transmission mechanism by the latch mechanism is constructed.

Figure 6:
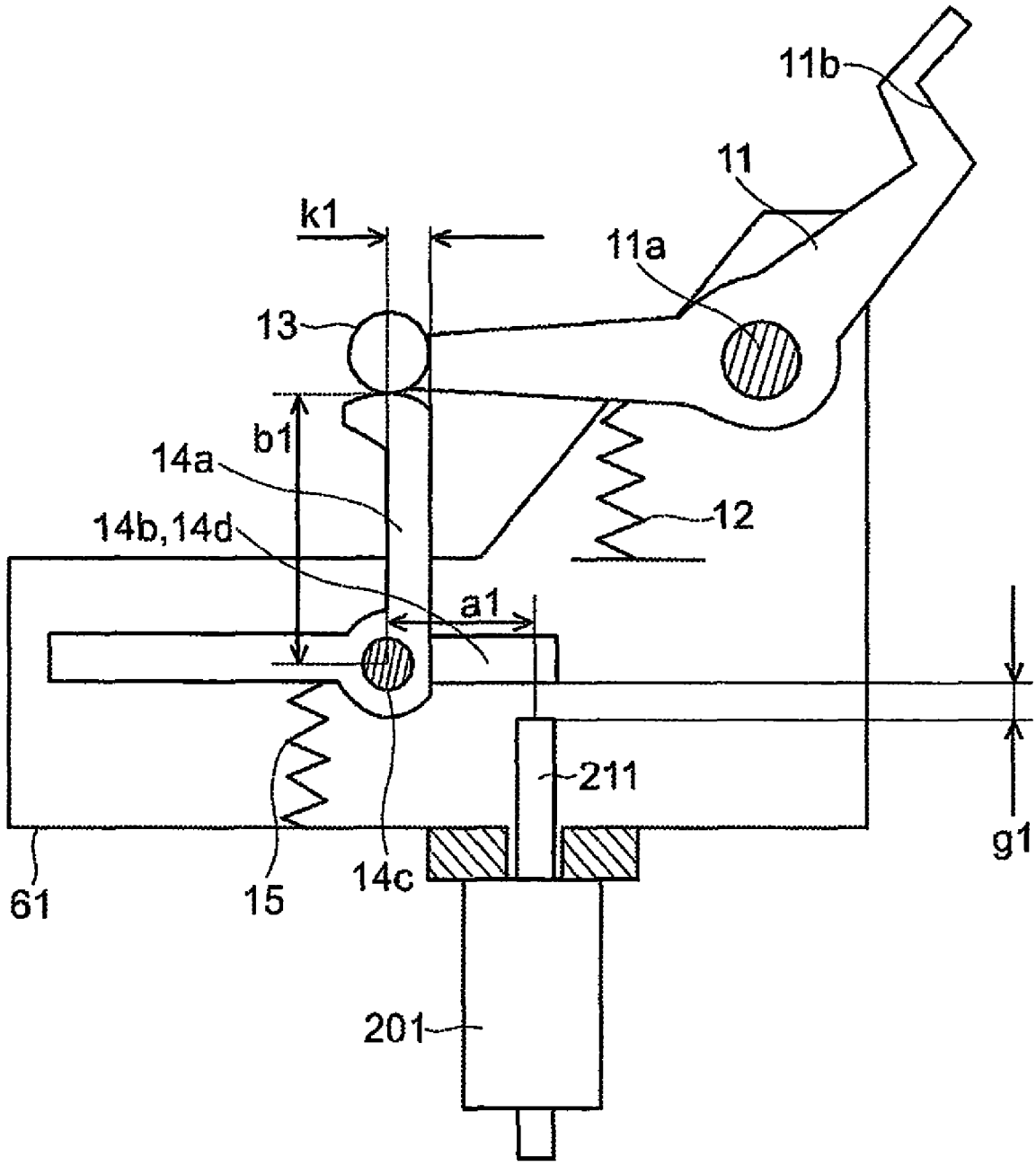
FIG. 6 is a front view showing an example of a pulled-out operation apparatus for low speed interruption.
Figure 7:
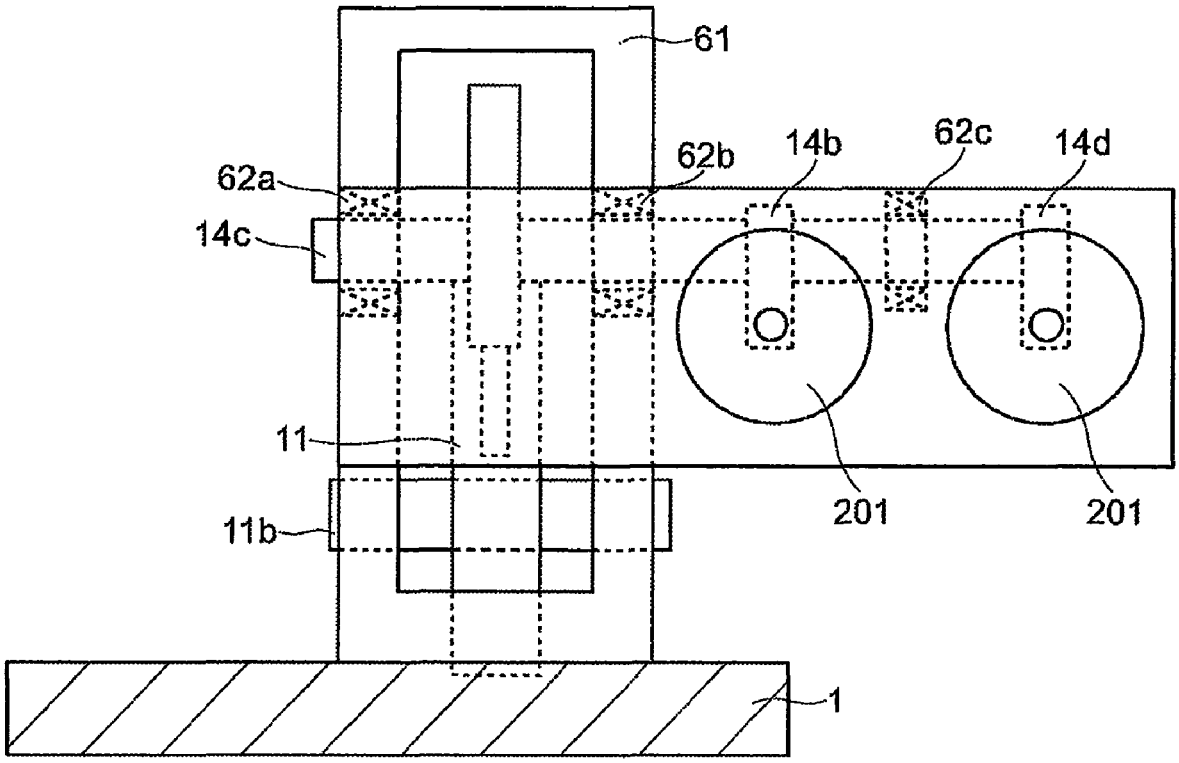
FIG. 7 is arrangement view, viewed from an under side, of the pulled-out operation apparatus for low speed interruption in FIG. 6.
Figure 8:
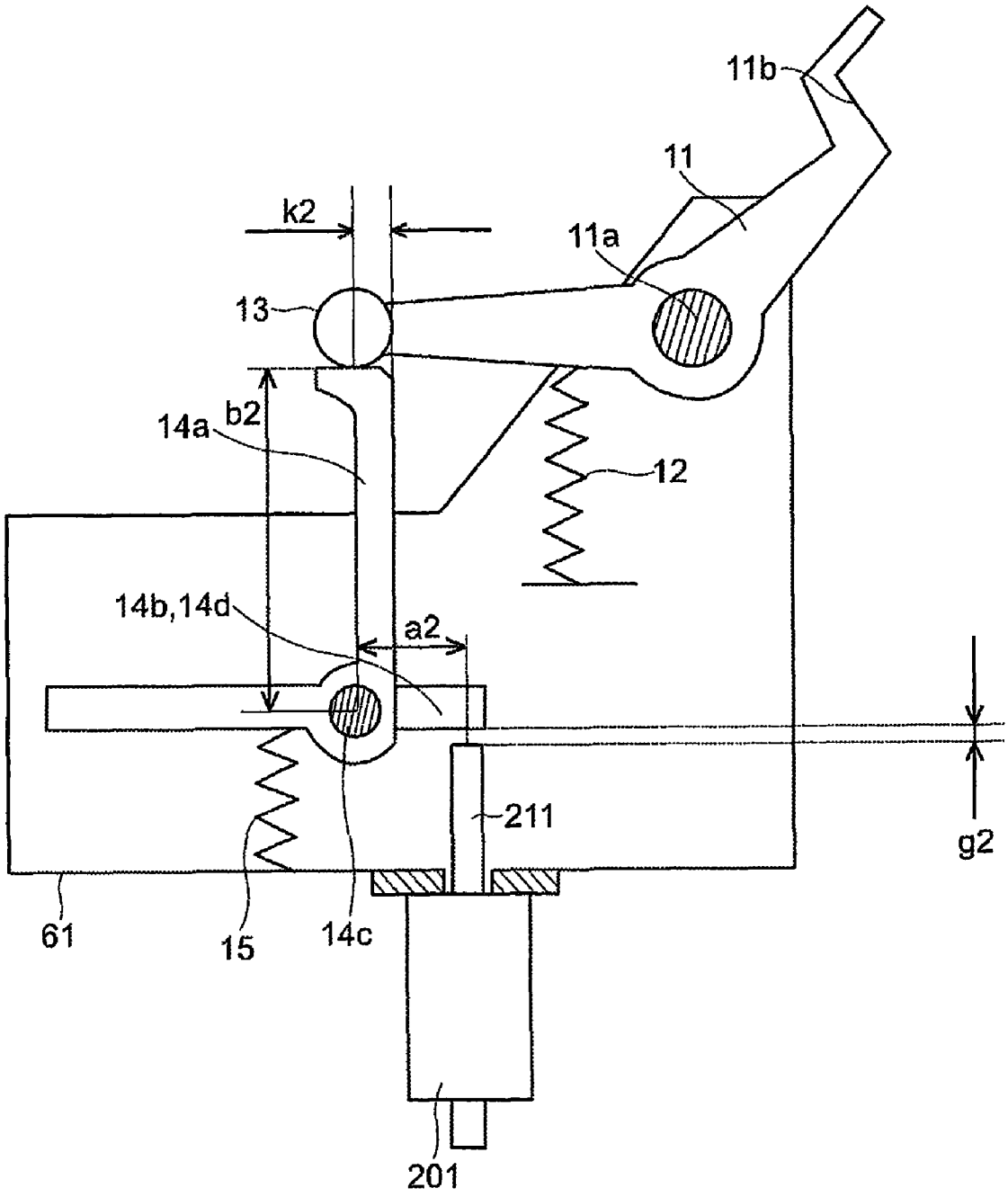
FIG. 8 is a front view showing an example of a pulled-out operation apparatus for high speed interruption.
Figure 9:
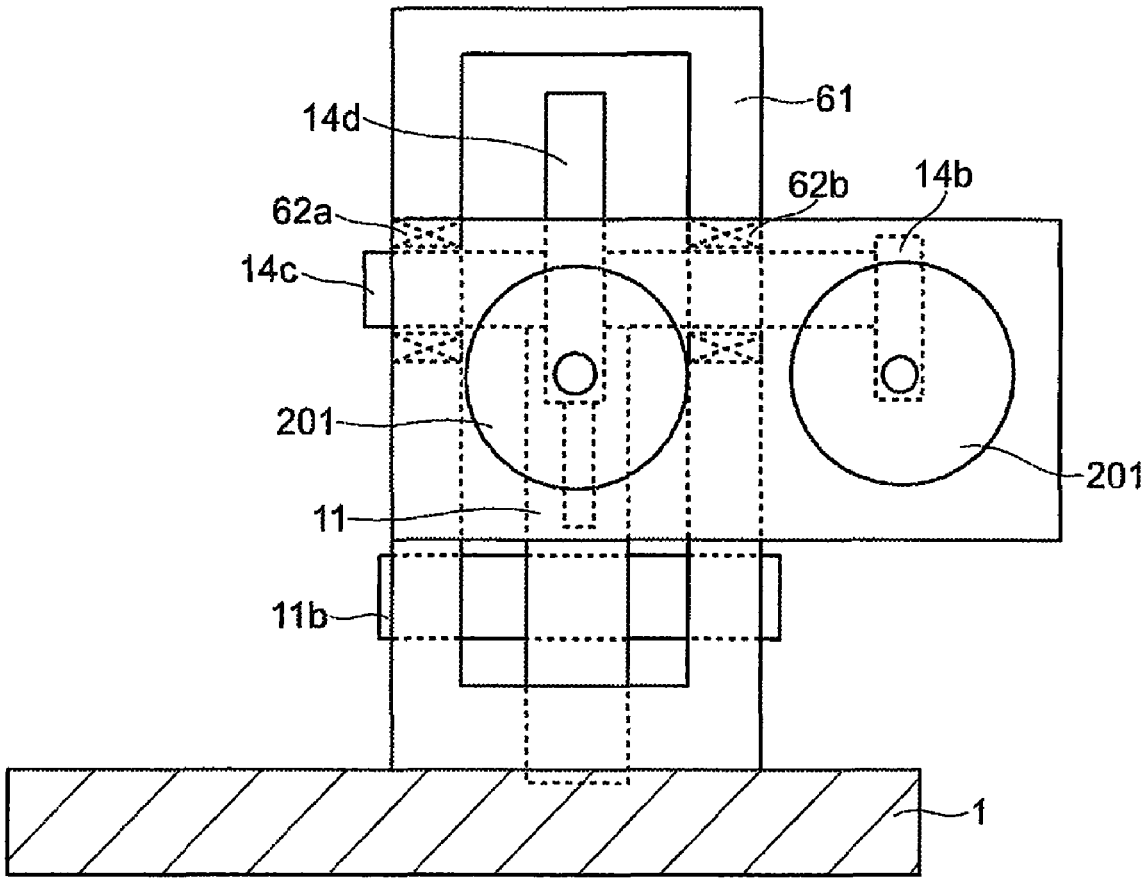
FIG. 9 is arrangement view, viewed from an under side, of the pulled-out operation apparatus for high speed interruption in FIG. 8.

Next, the pull-out operation section applying the present invention is explained in detail, referring to FIGS. 6-9. A construction of the pull-out operation section for high speed interruption such as 2 cycle interruption is different from one for low speed interruption such as 3 cycle or 5 cycle interruption. FIGS. 6 and 7 show a construction of the pull-out operation section for low speed interruption, and FIGS. 8 and 9 show a construction of the pull-out operation section for high speed interruption.

In the pull-out operation section for low speed interruption in FIGS. 6 and 7, suffix 1 is added to each of English letters, and suffix 2 is added to each of English letters in the pull-out operation section for high speed interruption in FIGS. 8 and 9. Gaps g1 and g2 each are a dimension between the solenoid plunger 211 and the first trigger lever 14*b* which is a first arm, they are set g1>g2, that is, the dimension of the pull-out operation section for low speed interruption is set a larger dimension than that of the pull-out operation section for high speed interruption, whereby a construction suitable for high speed interruption is made. Further, engage lengths k1, k2 each are a dimension that the roller 13 provided on the second trigger lever 11 and the interruption trigger 14*a* are engaged with each other, and they are set k1=k2. Namely, the engage lengths k1, k2 are made constant irrespective of interruption speed.

Each of a1 and a2 is a dimension from a central axis of the shaft 14*c* rotatably supporting the interruption trigger 14*a* to a perpendicular line of extension of an operation axis line of the solenoid plunger 21 extended to the first trigger 14*b* which is one arm, and they are set a1>a2. Each of b1 and b2 is a dimension from a central axis of the shaft 14*c* of the interruption trigger 14*a* which is a second arm to the tip contact portion of the interruption trigger 14*a* contacting with the roller 13 as mentioned above, that is, to the outer peripheral surface of the roller 13 of the second trigger lever 11, and they are set b1<b2. Defining a low speed interruption lever ratio r1 as r1=b1/a1, and a high speed interruption lever ration r2 as r2=b2/a2, a relation between the low speed interruption lever ratio r1 and the high speed interruption lever ratio r2 is set to be r1<r2. It is possible to rapidly release the engagement of the interruption trigger 14*a* and the roller 13 by making the ratio (r2/r1) of both levers 1.5 or more, and it becomes suitable as the pull-out operation section for high speed interruption.

Each of the pull-out operation section for low speed interruption and the pull-out operation section for high speed interruption are explained, referring to arrangement drawings viewed from the underside, shown in FIGS. 7 and 9. As shown in those FIGS. 7 and 9, two of the solenoids 201 for pulling out that are operation means are arranged in parallel with each other along the shaft 14*c*. This is because in a gas circuit breaker that a rated voltage is extra high voltage class of 200 kV or more, the pull-out control system is made in dual system in general, so that even if one of them falls in out of order, the other does surely an interruption operation.

In the pull-out operation section for low speed interruption in FIG. 7, one of the solenoids 201 for pulling out on the side of the small case 61 is formed so as to press the first trigger 14*b*, and the other solenoid 201 is formed so as to press the first trigger 14*d* arranged in parallel and outside of the first trigger 14*b*. Since two of the solenoids 201 for pulling out and the first triggers 14*b* and 14*d* are arranged out of the small case 61, the shaft 14*c* of the interruption trigger becomes long, therefore, three bearings are provided at the small case portion 61 and outside the small case portion as shown by 62*a*, 62*b* and 62*c*.

On the contrary, in the pull-out operation section for high speed interruption in FIG. 9, one of the pull out solenoids 201 is formed so as to directly press an interruption trigger 14*d* positioned inside the small case 61. Further, the other of the pull out solenoids 201 outside the small case 61 is formed so as to press the first trigger lever 14*b*. The first trigger lever 14*b* is in parallel with the interruption trigger 14*d*, however, the first trigger lever 14*b* is provided out of the small case 61. Therefore, a shaft 14*c* of the interruption trigger for high speed interruption becomes shorter than the shaft 14*c* of the interruption trigger for low speed interruption, so that the shaft 14*c* is supported rotatably by two bearings 62*a* and 62*b* provided on the small case portion 61.

As mentioned above, since the pull-out operation section for high speed interruption is constructed so that one of the pull-out solenoid 201 directly presses the interruption trigger 14*d*, the dimension of the shaft 14*c* of the interruption trigger 14 becomes shorter than that for low speed interruption, and the number of the bearings 62 supporting the interruption trigger shaft 14*c* can be also reduced, therefore, inertial mass around the interruption trigger 14 can be reduced more than that for low speed interruption. As a result, the pull-out operation section for high speed interruption makes its high speed operation possible, and it is possible to make the constructional cost low.

Further, the pull-out operation section according to the present invention is contained in the small case 61 as different parts for each specification of different interruption speed, and fixed detachably to the case 1 by common fixing means. Thereby, it is possible to meet the requirement of different interruption speeds with the same circuit breaker only by exchanging the small case 61 containing the pull-out operation section. Further, since it is possible to make various kinds of structural parts contained in the case 1, various kinds of parts constructing the power transmission mechanism, etc. common, it is possible to reduce the working time for designing and manufacturing the circuit breaker. Particularly, the pull-out operation section according to the present invention can be detachably attached to the case inside the operation box of the circuit breaker by common fastening means, as shown FIG. 1, so that it is possible to make a structure of circuit breaker portions other than the pull-out operation section common irrespective of interruption speed specification and standardize the circuit breaker.

Figure 10:
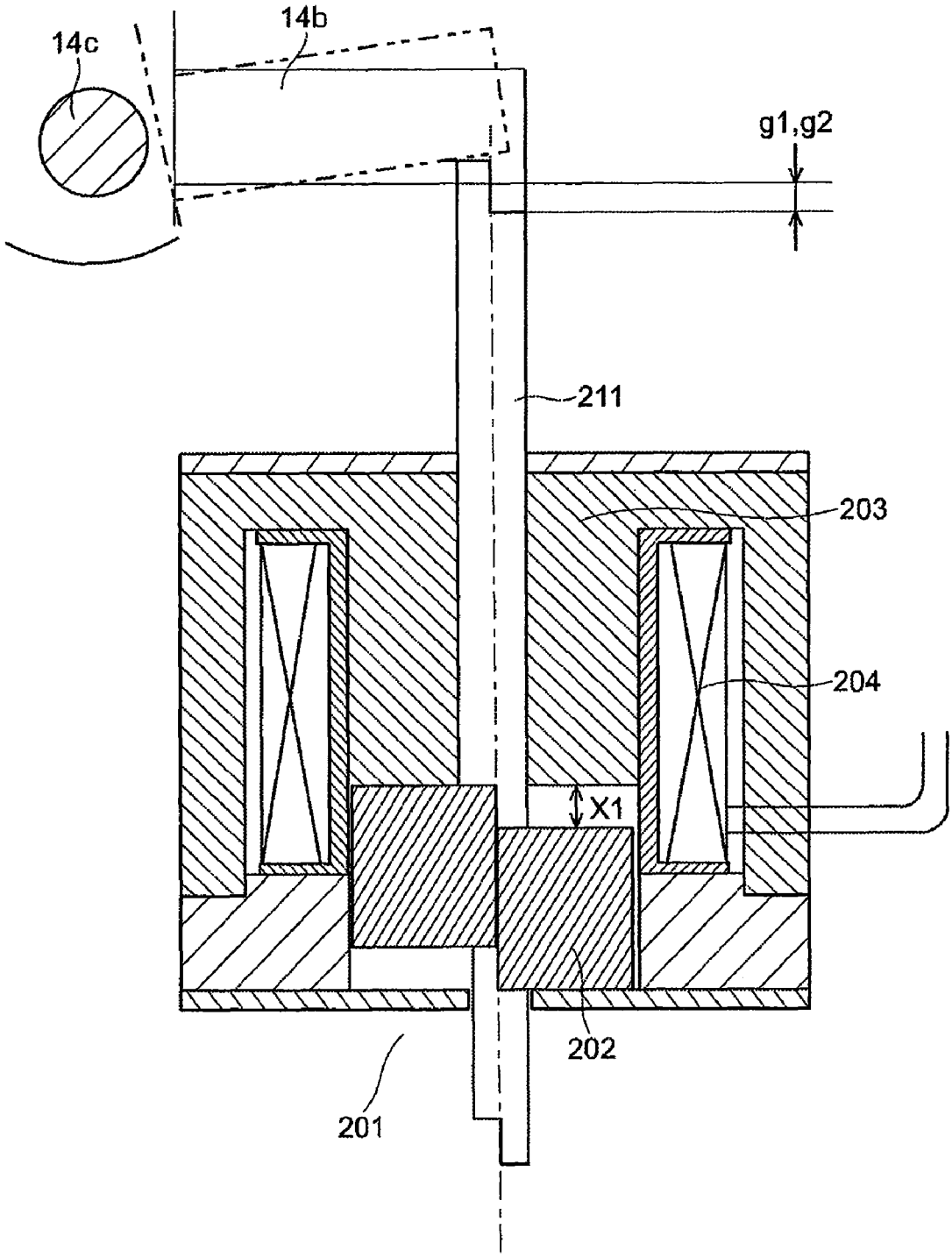
FIG. 10 is a sectional view of a solenoid before and after operation.

States of the pull-out solenoid before and after interruption operation are shown in FIG. 10. In this figure, its left half shows a state before the interruption operation, and its right half shows a state after the interruption operation. The plunger 211 is made of non-magnetic material such as stainless steel (SUS304). The plunger 211 has a movable core 202 of magnetic material coaxially placed thereon and fixed thereto, and a fixed core 203 is provided so as to oppose to the movable core 202. The fixed core 203 has a coil 204 contained therein.

Before an interruption operation, there is a gap X1 of a prescribed dimension between the movable core 202 and the fixed core 203. When an interruption command is inputted from the control means (not shown), the coil 204 is excited, the movable core 202 is attracted to the fixed core 203 by the magnetic field generated in the iron core, the gap X1 is gradually reduced, and finally the movement of the movable core 202 stops substantially at the state that the movable core 202 abuts the fixed core 203.

Figure 11:
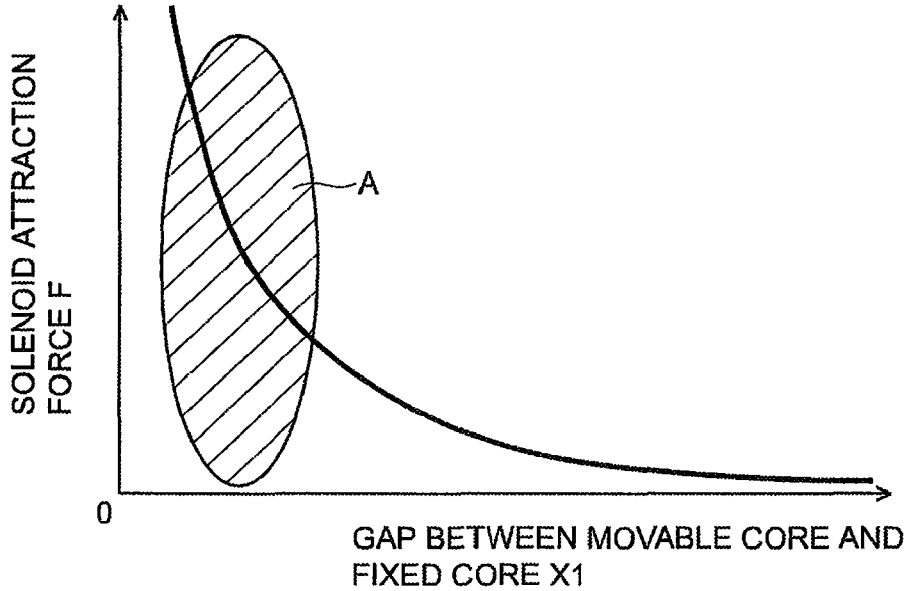
FIG. 11 is a characteristic diagram.

Attracting force of the solenoid under the state that steady current is flowing in the coil is in inverse proportion to the gap X1 between the movable core 202 and the fixed core. Namely, the smaller the gap X1 is, the larger the attracting force of the solenoid becomes. Therefore, in the pull-out operation section for high speed interruption, as mentioned above a gap g2 between the plunger 211 and the interruption trigger 14*b* is made smaller than a gap g1 in the pull-out operation section for low speed interruption, whereby a region A in which the gap X1 is small and the attracting force of the solenoid is large, as shown in FIG. 11, is used.

That is, as for the pull-out operation section for low speed interruption and the pull-out operation section for high speed interruption, it is possible to meet the requirement of different interruption speeds with the same construction of the circuit breaker by making a lever ratio or a gap between those pull-out operation sections different from each other such as the lever ration r1<r2 or the gap g1>g2.

Further, in the pull-out operation section for high speed interruption and the pull-out operation section for low speed interruption, the material of movable core 202 and the fixed core 203 can be changed to other materials. Namely, it is possible for the pull-out operation section for high speed interruption, to obtain much larger attracting force by increasing the magnetic flux generated in the cores by making use of material excellent in magnetic property, and it is possible to meet the requirements of different interruption speeds with a circuit breaker of the same construction.

Figure 12:
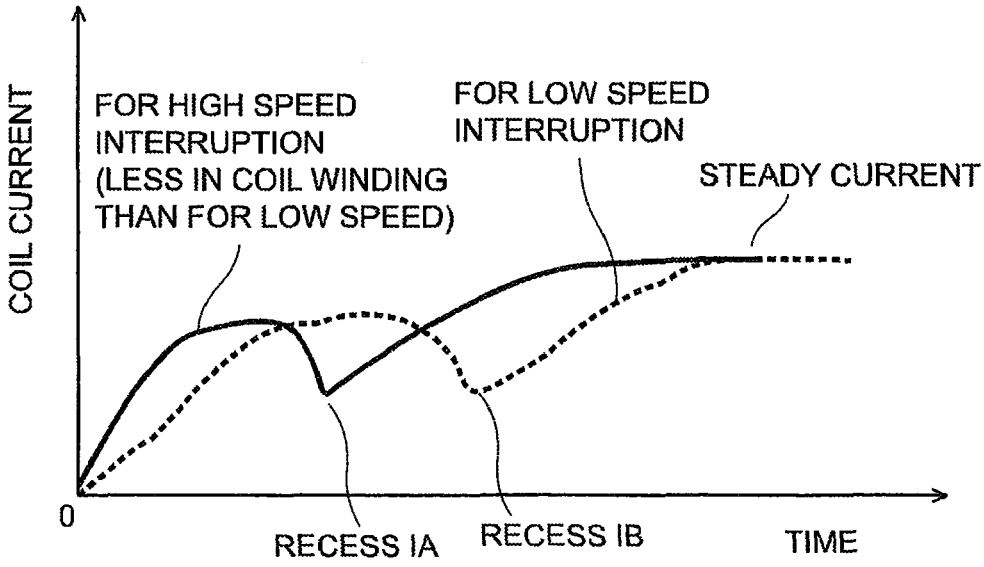
FIG. 12 is an explanation diagram showing time change of current flowing in a solenoid coil.

Still further, between the pull-out operation section for low speed interruption and the pull-out operation section for high speed interruption, the numbers of windings of the solenoid coils 204 are different from each other, and the number of windings of the coil 204 for high speed interruption is less than that of the coil 204 for low speed interruption. FIG. 12 typically expresses transient response characteristics of current flowing in solenoid coils when the numbers of windings of the coils are different. When an interruption command is inputted at time zero, current in the coil does not immediately reach a steady current because of inductance, a current increase stays once and a recess appears in current wave as shown in FIG. 12, and then the current increases again toward the steady current. A position that the recess appears in current wave expresses a state that the solenoid plunger 211 is in full stroke, that is, an instant that the gap X1 between the movable core 202 and the fixed core 203 reaches approximately zero. Defining time from the time zero to the time that a recess 1A, 1B appears in the current wave as response time, the response time becomes fast (short) because the coil for high speed interruption is made less in number of windings than that the coil for low speed interruption, and high speed interruption is possible.

As mentioned above, it is possible to provide a circuit breaker different in interruption speed in requirement even by making the number of windings different between the pull-out operation section for low speed interruption and the pull-out operation section for high speed interruption.

An operation of the gas circuit breaker 100 constructed as above will be described hereunder. First, an operation shifting from a closing state as shown FIG. 3 to an interruption state is explained. Under the closing state, when an interruption command is inputted, the gas circuit breaker 100 starts interruption operation. The pull-out solenoid 201 of the pull-out operation section is excited, the plunger 211 projects, and the plunger 211 presses the first trigger lever 14*b*. As a result, the engagement of the interruption trigger 14*a* and the second trigger lever 11 is disengaged.

The second trigger lever 11 is made freely rotatable, being disengaged from the interruption trigger 14*a*, and the second trigger lever 11 is pressed by the roller 10 of the interruption latch 8, the second trigger lever 11 rotates about the shaft 11*a* counterclockwise, that is, in an anticlockwise direction. Consecutively, the interruption latch 8 restricted to rotate is made freely rotatable, and the interruption latch 8 rotates counterclockwise about the shaft 8*a* by a pressing force from the roller 7 of the main lever 5. Therefore, the engagement of the roller 7 of the main lever 5 and the interruption latch 8 is disengaged, and rotation of the main lever 5 is made free. Thereby, restriction of the interruption spring 26 under compression is released, so that the interruption spring 26 is disenergized, and the main lever 5 rotates counterclockwise. Thereby, the interruption operation of the make and break contact which is the interruption portion is done. When disenergization of the interruption spring 26 is finished, the interruption operation is finished. The roller 6 of the main lever 5 stops in a state that the roller nearly abuts the outer peripheral surface of the cam 3 on the closing operation section side as shown in FIG. 4.

Figure 13:
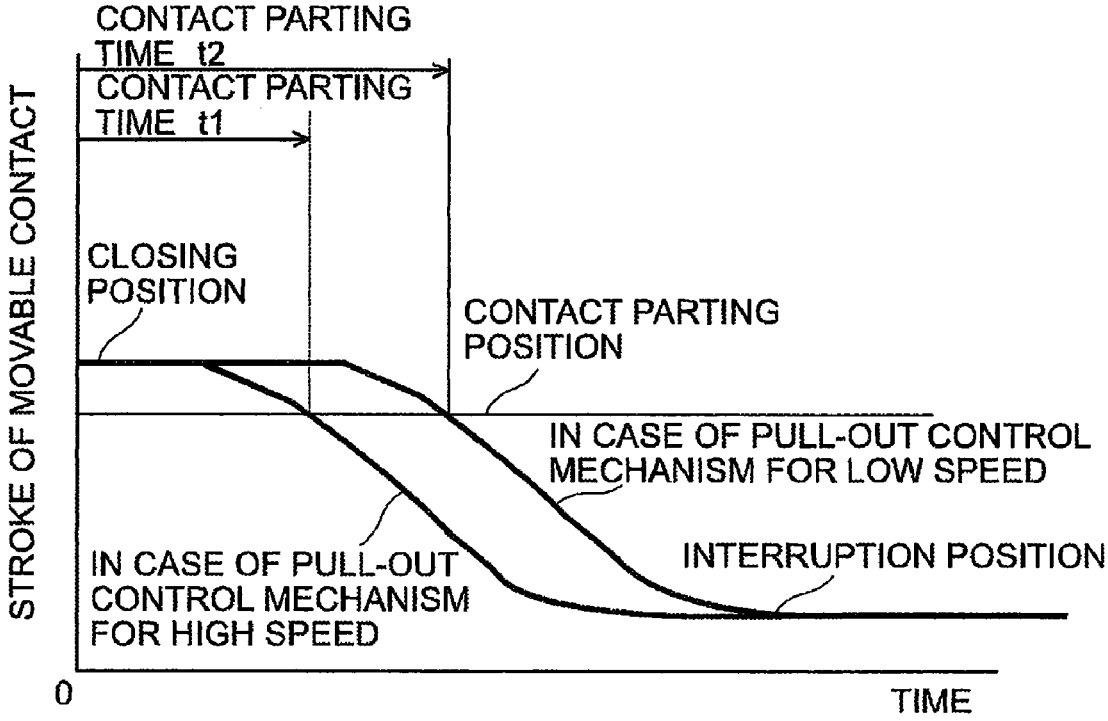
FIG. 13 is an explanation diagram showing time change of stroke of a movable contact.

FIG. 13 shows a change in displacement of the movable contact 63 according to time lapse, with the construction of the circuit breaker shown in FIG. 1. An instant that an interruption command is inputted is time zero. In the pull-out operation section, the interruption spring 26 is not disenergized while the engagement of respective levers is not disengaged, so that the movable contact is in stationary state, and the stroke does not change from the time zero as shown in FIG. 13. In the pull-out operation section for high speed interruption, the response time of the coil 204 of the solenoid is fast (short), and disengagement of the interruption trigger 14*a* and the roller 11 of the second trigger lever 11 is fast. Therefore, in the pull-out operation section for high speed interruption, the contact parting time (opening time) t1 until the stroke of the movable contact reaches to a contact parting position is faster (shorter) than the contact parting time t2 until that for low speed interruption reaches the contact parting position. In this manner, by a change in construction of a portion of the pull-out operation section, it is possible to use a single gas circuit breaker of the same construction both for high speed interruption and for low speed interruption by exchanging the circuit breaker to one for high speed interruption and one for low speed interruption.

An operation that the contact shifts from the interruption state to the closing state shown in FIG. 5 is explained hereunder. Under the interruption state shown in FIG. 4, when a closing command is inputted to the gas circuit breaker 100, the solenoid 301 for closing is excited. The solenoid 301 for closing makes the plunger 311 project downward and press the closing trigger 22. Thereby, the closing trigger 22 rotates and moves counterclockwise, and the engagement of the roller 21 of the closing latch 19 and the closing trigger 22 is disengaged.

Thereby, rotation of the closing latch 19 restricted to rotate becomes free, so that the closing latch 19 rotates and moves counterclockwise by the pressing force from the roller 18 of the cam 3. At this time, the engagement of the closing latch 19 and the roller 18 of the cam 3 is disengaged. Since the cam 3 becomes free from restriction to rotate, the spring force of the closing spring 28 is disenergized, the closing spring link 27 moves downward, and the large gearwheel 52, the rotation shaft 2 and the cam 3 rotate counterclockwise.

Being accompanied by the rotation of the cam 3, the outer peripheral surface of the cam 3 abuts the roller 6 of the main lever 5, and the main lever 5 rotates and moves clockwise. When the cam 3 rotates approximately half rotation, the outer peripheral surface abuts the roller 6 of the main lever 5 at a maximum curvature radial portion of the cam 3. At this time, the interruption spring link 25 connected to the main lever 5 compresses the interruption spring 26 to a nearly original position.

When the closing spring 28 has been disenergized, the make and break contact is closed. Further, when the closing operation is finished, each lever 8, 11, 14 of the pull-out mechanism 401 is restored to the original position by the force of the return spring 9, 12, 15. Thereby, the force of the interruption spring 26 is held. The state that the closing operation is finished is as shown in FIG. 5. Under this state, when an interruption command is inputted, an interruption operation becomes instantly possible. Namely, driving energy corresponding to twice of interruption operation and once of closing operation is stored before the first interruption operation, whereby operation duty of high speed re-closed circuit defined by Japanese Electro-technical Committees Electrical Standards Investigation Committees Standard Specification (JEC-2300), O-0.35 sec-CO operation becomes possible. Here, O means interruption operation and CO means that interruption operation is done after the closing operation on.

An operation of energizing the closing spring after the closing operation is finished is explained hereunder. In FIG. 5, when an electric motor (not shown) rotates the small gearwheel 51 clockwise through gear trains (not shown), the large gearwheel 52 meshed with the small gearwheel 51 rotates counterclockwise. Based on this operation, the closing spring link 27 moves downward while moving counterclockwise, and the closing spring is compressed. When the rotation of the large gearwheel 52 passes about half rotation, the electric motor stops by a command of a limit switch (not shown). By the driving force of the compressed closing spring 28, the large gearwheel 52 is urged so as to further rotate counterclockwise, however, the roller 18 of the cam 3 coaxial with the large gearwheel 52, and the closing latch 19 become the states that they are engaged with the closing latch 19 and the closing trigger 22, respectively, as shown in FIG. 3. Therefore, rotations of the cam 3 and the closing spring 28 are restricted, and the spring force of the closing spring 28 is held. Thereby, they becomes the state shown in FIG. 3 holding closing of the make and break contact, and the interruption spring 26 and the closing spring 28 each are restored to the original state that those spring are compressed.

As mentioned above, according to the present invention, it is possible to easily produce circuit breakers different in interruption performance such as 2 cycle interruption, 3 cycle interruption and 5 cycle interruption by only exchanging structural parts of one portion of the pull-out operation section. Further, by exchanging the pull-out operation section constructing the pull-out mechanism, even with one gas circuit breaker of the same construction, it is possible to use it changing interruption time to 2 cycle and 3cycle.

Further, in this embodiment, the pull-out operation section is constructed in 2 stage construction of the first trigger lever 14*b* and the second trigger lever 11, however, without being limited by this as singularity of the first trigger lever 14*b* for instance, it is sufficient to provide the first trigger lever 14*b* so that the tip portion of the interruption trigger 14*a* abuts directly the roller 10 of the interruption latch 8. Further, it is also possible to construct it in 3 stages or more of the number of stages.

POSSIBILITY OF INDUSTRIAL UTILIZATION

As mentioned above, in the circuit breakers according to the present invention, even if main parts are made in the same construction, it is possible to make one of them in a circuit breaker for different interruption speed by exchanging a portion of the pull-out mechanism, whereby it is suitable for designing and manufacturing power circuit breakers.

What is claimed is:

1. A circuit breaker comprising:

a power transmission mechanism for driving a movable contact and a fixed contact constructing a make and break contact in a direction that said contacts separate from each other and contact thereon, an interruption spring imparting driving force in a direction that the driving force separates said movable contact from said fixed contact through said power transmission mechanism, a case incorporated with a latch mechanism for restricting movement of said power transmission mechanism at a place that an energized condition of said interruption spring is held, and a small case incorporated with a pull-out operation section for releasing the restriction of said power transmission mechanism by said latch mechanism and detachably fixed to said case, characterized in that said pull-out operation section incorporated in said small case is provided with a lever having first and second arms and rotatably supported on a shaft, and operation means for rotating said first arm, said operation means being arranged so as to oppose to said first arm of said lever, said lever is arranged so that a tip of said second arm is able to engage with and rest on said latch mechanism, and made so that the restriction of said power transmission mechanism by said latch mechanism is released by rotation of said lever, said small case is provided with at least for high speed interruption and for low speed interruption, and one of them combined with said case according to the duty, a gap between said first arm and said operation means is set larger for low speed interruption than for high speed interruption, and a ratio b1/a1 of a length between said second arm and said first arm of said lever is set larger for high speed interruption than for low speed interruption.

2. A circuit breaker according to claim 1, wherein said length ratio b1/a1 between said first arm and second arm for high speed interruption is set 1.5 times or more of that for low speed interruption.

3. A circuit breaker according to claim 1, wherein said operation means comprises a solenoid driving a plunger to go forward and backward, and the number of winding of a coil of said solenoid is less for high speed interruption than for low speed interruption.

4. A circuit breaker according to claim 1, wherein said operation means comprises a solenoid driving a plunger to go forward and backward, said solenoid having an iron core made of material different in magnetic property and specific resistance each different between for high speed interruption and for low speed interruption.

* * * * *